US007299795B2

(12) United States Patent
Brannen

(10) Patent No.: US 7,299,795 B2
(45) Date of Patent: Nov. 27, 2007

(54) HOLDING-WEIGHT TRANSFER FOR A BOW

(76) Inventor: Charles M. Brannen, 3295 US 221 North, Perry, FL (US) 32347

( * ) Notice: Subject to any disclaimer, the term of this patent is extended or adjusted under 35 U.S.C. 154(b) by 114 days.

(21) Appl. No.: 11/269,995

(22) Filed: Nov. 9, 2005

(65) Prior Publication Data

US 2007/0101978 A1 May 10, 2007

(51) Int. Cl.
*F41B 5/18* (2006.01)

(52) U.S. Cl. ..... 124/35.2; 124/86

(58) Field of Classification Search ..... 124/23.1, 124/35.2, 86, 88

See application file for complete search history.

(56) References Cited

U.S. PATENT DOCUMENTS 3,561,418 A 2/1971 Fredrickson
3,895,621 A 7/1975 Kellogg
5,092,308 A 3/1992 Sheffield
5,156,138 A 10/1992 Grover
5,390,654 A 2/1995 Perkins
5,649,524 A 7/1997 Pullin
5,944,004 A 8/1999 Goff et al.
6,161,532 A 12/2000 Goff et al.
6,679,240 B1 1/2004 Hurd

*Primary Examiner*—John A. Ricci
(74) *Attorney, Agent, or Firm*—John Wiley Horton

(57) ABSTRACT

A device for transferring the drawn weight of a bowstring from a user's bowstring gripping hand to a user's bow gripping hand. The device includes a shaft and a means for releasably connecting the bowstring to the device, such as a trigger release. The device also includes a transfer grip which has a gripping portion configured to be grasped by the user's bow gripping hand together with the bow grip when the user draws the device and bowstring to the drawn position. In the preferred embodiment, a handle is used on one end of the shaft and the trigger release is attached to the handle so that the user can use their bowstring gripping hand to draw the device together with the bowstring to the drawn position and then actuate the release of the bowstring using the trigger of the trigger release. A receiver is also provided for receiving the shaft of the device when the device is drawn from the undrawn position to the drawn position.

19 Claims, 7 Drawing Sheets

HOLDING-WEIGHT TRANSFER FOR A BOW

BACKGROUND OF THE INVENTION

1. Field of the Invention

This invention relates to the field of archery. More specifically, the present invention comprises a device for transferring the drawn-weight of a bowstring to the bow-gripping hand of the archer.

2. Description of the Related Art

Target archery and hunting archery are popular sports enjoyed by many people. Many developments in the field of archery have dramatically improved accuracy and precision. Improvements in the aerodynamics of the arrow and the holding weight let-off of the bow are two examples of such developments.

"Holding weight" describes the force that an archer must provide to a bow's bowstring to hold the bowstring in the drawn position (ready to fire). "Drawing weight" describes the force that an archer must provide to draw the bowstring to the drawn position. In most modem bows, the holding weight and drawing weight for a bow are not the same. Eccentrics and cam systems are commonly used on compound bows to increase mechanical advantage and reduce the holding weight of a bow when the bowstring is pulled to the drawn position. This results in the peak of the drawing force curve to occur prior to reaching the drawn position. The difference between the drawing weight and the holding weight is known as the bow's "let-off."

The holding weight of a bow can greatly impact an archer's accuracy. It is generally desirable for archers to be able to relax their muscles when they are aiming at a target. For bows with large holding weights, holding the bow in the drawn position may cause the archer's arms to shake as the archer's muscles strain to hold the bow drawn. Even for bows with large let-off, holding the bow in the drawn position for long periods of time can cause discomfort and unsteadiness. In hunting archery applications, an archer may often need to draw the bow and hold the bow in the drawn position for significant lengths of times as the archer waits for the best opportunity to take a shot.

Several inventors have proposed mechanisms which can be used to lock a bow in the drawn position. These devices eliminate the holding weight of the bow as the bow bears the weight of the drawn bowstring itself. However, many jurisdictions have regulations which limit or completely prohibit the use of these devices in hunting applications. These regulations typically require the hunter to support the drawn weight of the bow-especially when the hunter is using the bow during a part of the hunting season where the use of other weapons—such as crossbows—are prohibited.

Accordingly it would be desirable to have a device which a hunter may use to reduce the strain associated with holding a bow in the drawn position while the hunter is holding the drawn weight of the bow.

BRIEF SUMMARY OF THE PRESENT INVENTION

The present invention comprises a device for transferring the drawn weight of a bowstring from a user's bowstring gripping hand to a user's bow gripping hand. The device includes a shaft and a means for releasably connecting the bowstring to the device, such as a trigger release. The device also includes a transfer grip which has a gripping portion configured to be grasped by the user's bow gripping hand together with the bow grip when the user draws the device and bowstring to the drawn position. In the preferred embodiment, a handle is used on one end of the shaft and the trigger release is attached to the handle so that the user can use his or her bowstring gripping hand to draw the device together with the bowstring to the drawn position and then actuate the release of the bowstring using the trigger. A receiver is also provided for receiving the shaft of the device when the device is drawn from the undrawn position to the drawn position.

REFERENCE NUMERALS IN THE DRAWINGS

Figure 1:
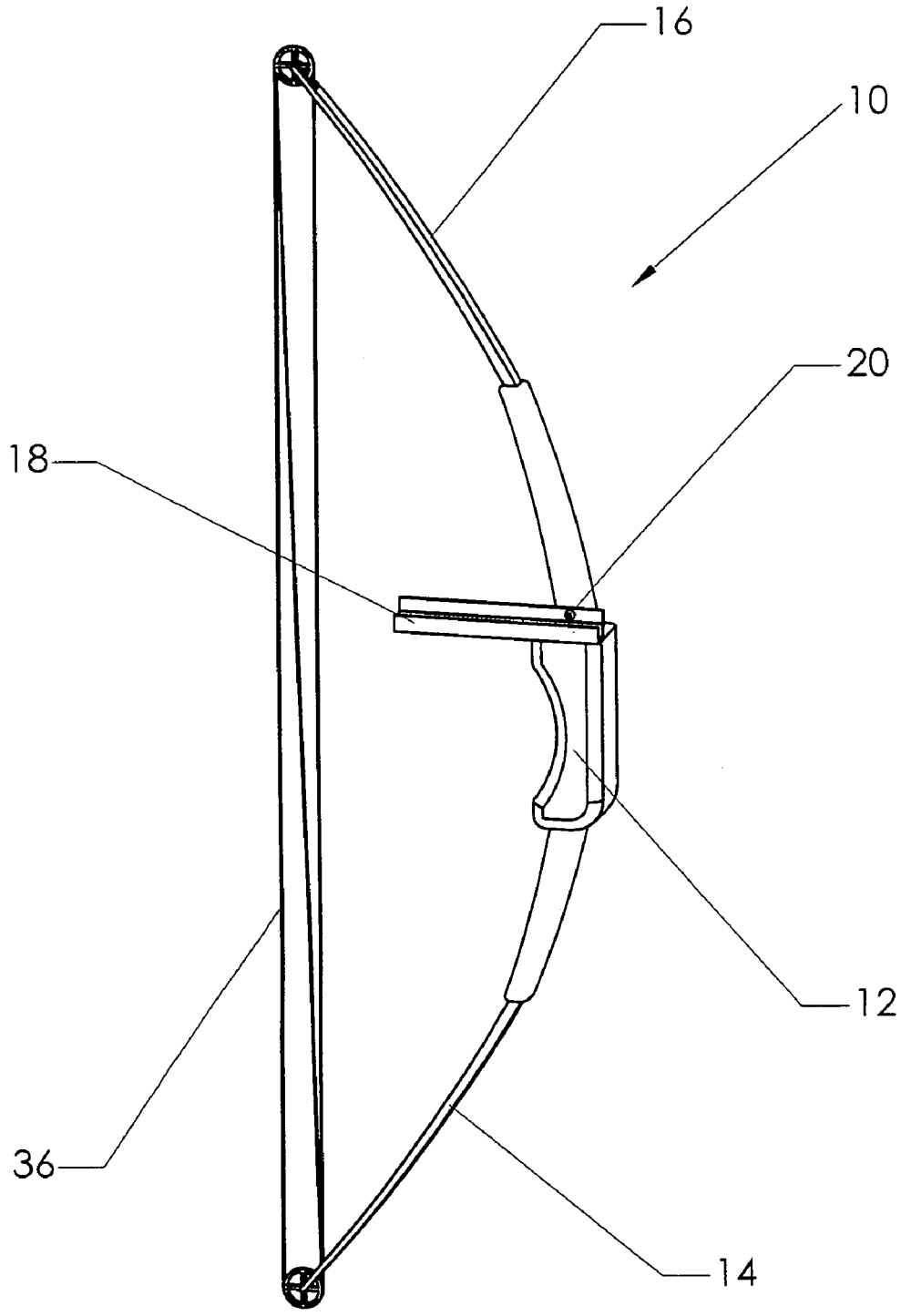
FIG. 1 is a perspective view, showing a receiver mounted on a bow.

10 bow 12 bow grip
14 bottom limb 16 top limb
18 receiver 20 receiver mount
22 mounting bore 24 slot
26 transfer 28 handle
30 trigger release 32 shaft
34 transfer grip 36 string
38 hand 40 arrow
42 arrow receiver

DETAILED DESCRIPTION OF THE INVENTION

Figure 3:
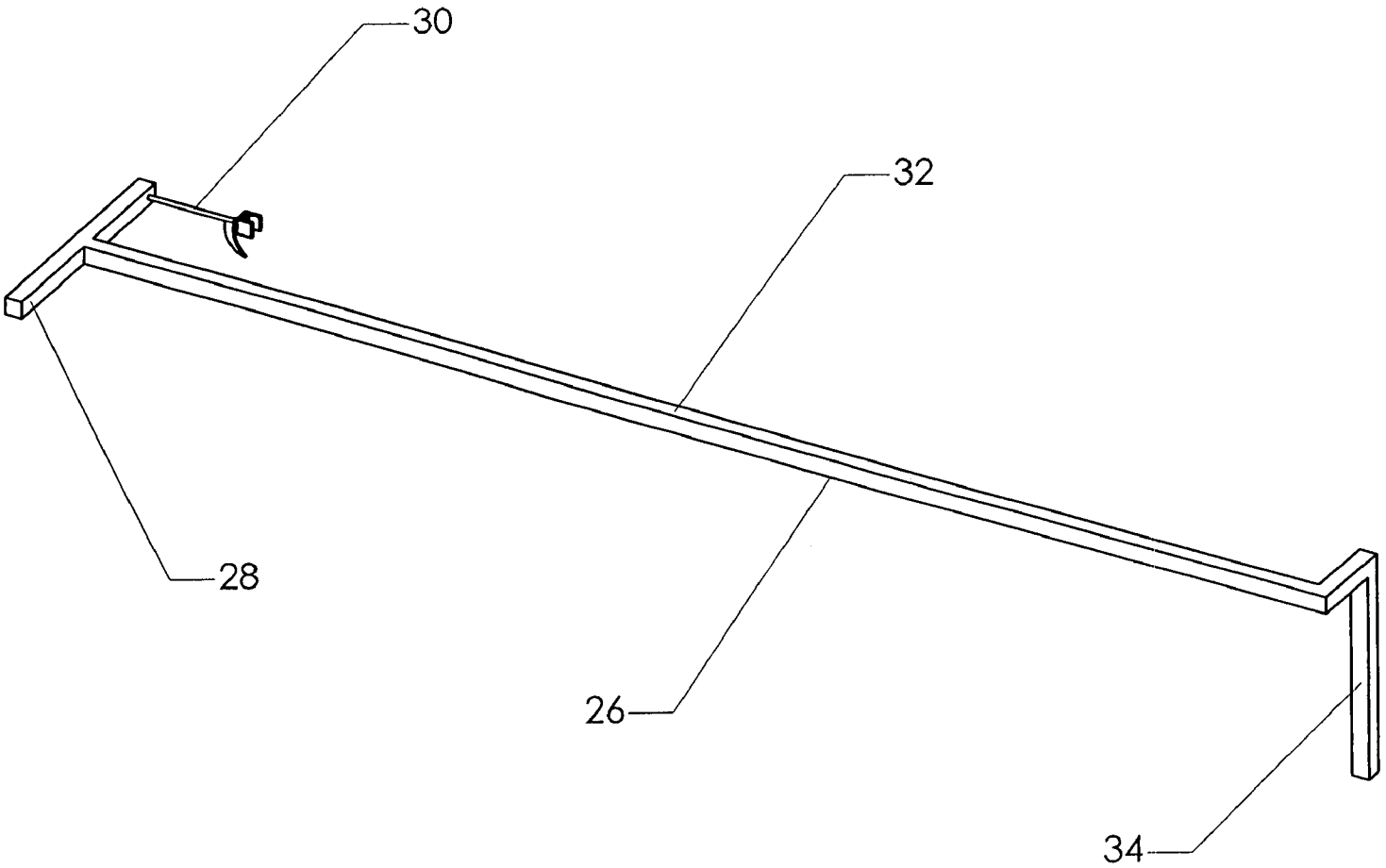
FIG. 3 is a perspective view, showing a transfer.

The invention's central component is shown in FIG. 3. Transfer 26 transfers the drawn-weight of a bowstring to the bow-gripping hand of the archer. FIG. 1 shows bow 10 with receiver 18 attached. Receiver 18 stabilizes transfer 26 and permits the transfer to be drawn together with a bowstring from the undrawn position to the drawn position. FIG. 1 shows bow 10 in the undrawn position. Bow 10 generally includes bow grip 12 which is situated between top limb 16 and bottom limb 14. String 36 is attached to bow 10 by a system of pulleys (which may be eccentric). Receiver 18 is attached to bow 10 right above bow grip 12 by receiver mount 20. Receiver mount 20 can be any type of fastener including a bolt or a screw. In addition, although a compound bow is shown in FIG. 1, it should be understood that the present invention can be used on any type of bow, including a long bow.

Figure 2:
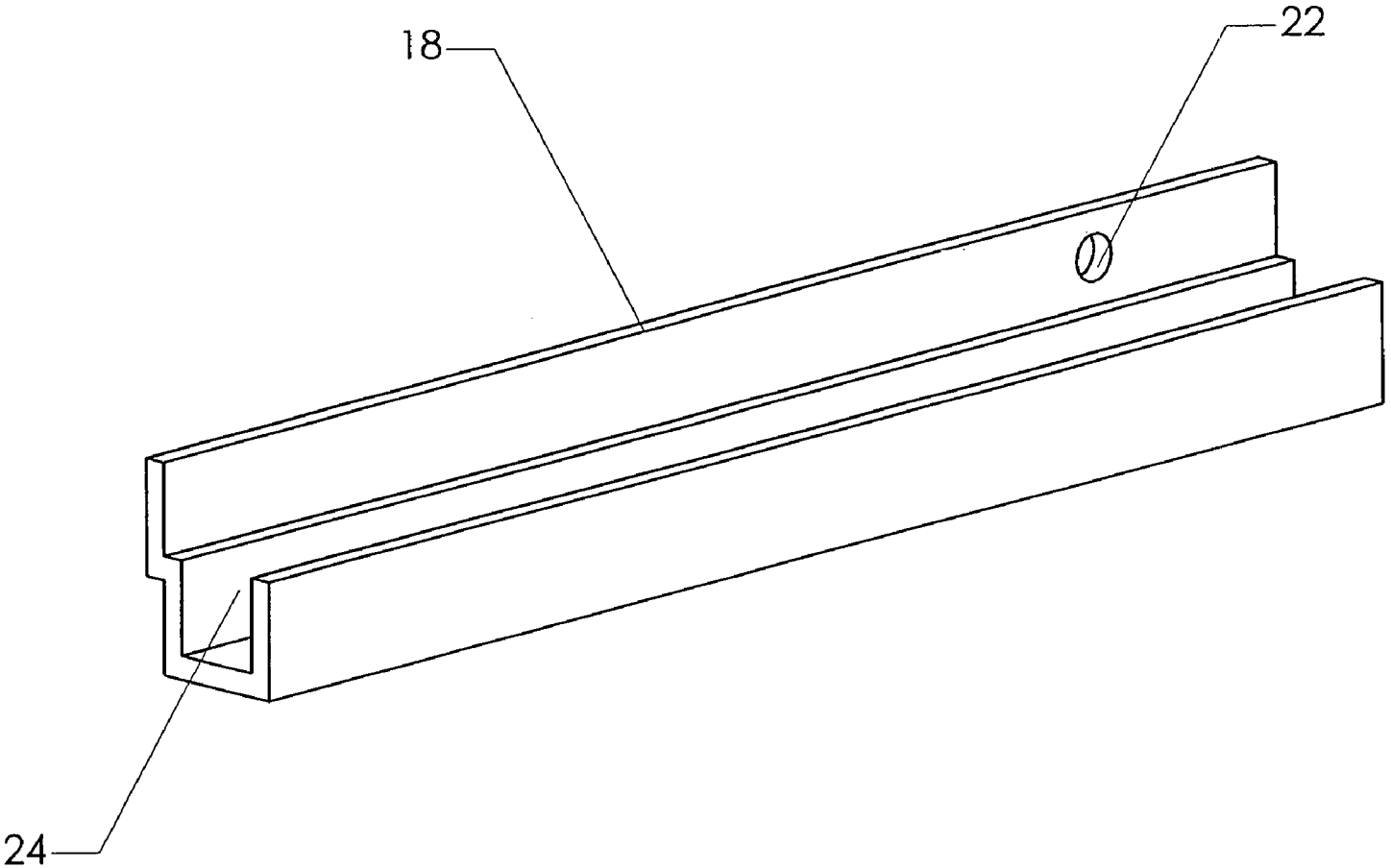
FIG. 2 is a perspective view, showing a receiver.

The preferred embodiment of receiver mount 20 is shown in greater detail in FIG. 2. Receiver 18 is generally in the shape of a bracket with slot 24. Slot 24 is configured to receive the shaft of transfer 26. In doing so, receiver 18 stabilized transfer 26 when transfer 26 is drawn from the undrawn position to the drawn position. Mounting bore 22 is provided near the top and front of receiver 18 so that receiver 18 can be bolted on to bow 10. The reader will appreciate that slot 24 is generally formed by two side walls which are connected by a base. Accordingly, transfer 26 can easily be placed in slot 24 and removed out of slot 24 through the top of slot 24. The reader will appreciate that the drawings illustrate right-hand version of the invention. A left-hand version would be a mirror image.

The preferred embodiment of transfer 26 is shown in greater detail in FIG. 3. Transfer 26 generally includes shaft 32 with handle 28 on one end and transfer grip 34 on the other end. As mentioned previously, shaft 32 is received in slot 24 of receiver 18. Handle 28 includes trigger release 30 for releasably connecting the bowstring to transfer 26. Trigger release 30 can be any means for connecting the bowstring to transfer 26 that is capable of supporting the drawing weight of the bow. A triggering mechanism is preferred so that the user may actuate the release of the bowstring from the transfer when the user is prepared to shoot the arrow. Many trigger releases are known in the art and any of these releasing mechanisms can be used for trigger release 30. The reader will appreciate that when handle 28 is orientated perpendicular to shaft 32 and trigger release 30 is attached to handle 28, the user can draw the bowstring and actuate the release of the bowstring comfortably with the same hand.

Transfer grip 34 includes a gripping portion which may be grasped by the user's bow gripping hand together with bow grip 12 when said transfer 26 is drawn to the drawn position. This feature of transfer grip 34 will be explained in greater detail subsequently. In the preferred embodiment, transfer grip 34 is laterally offset from shaft 32 so that the user can more easily grasp and hold transfer grip 34 and bow grip 12 together. Although transfer grip 34 is shown as a simple rectangular bar, it should be understood that transfer grip 34 can also be contoured or flattened to improve the user's comfort when holding the bow in the drawn position.

Figure 4:
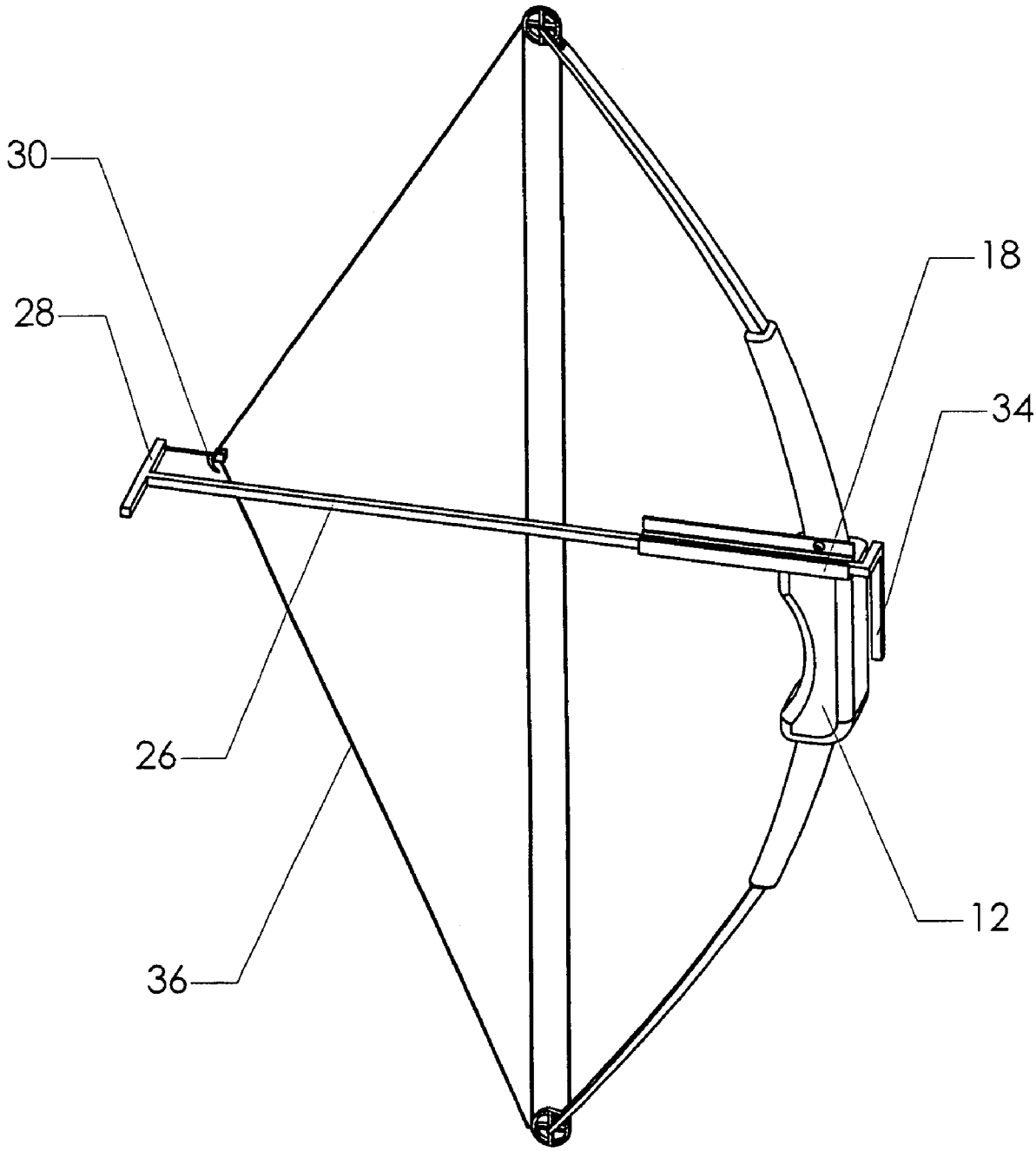
FIG. 4 is a perspective view, showing the present invention in use.

FIG. 4 shows the present invention in use. Bow 10 is in the drawn position. To accomplish this, the user first grasps bow grip 12 with their bow gripping hand, and string 36 is attached to trigger release 30. The user then grasps handle 28 with their normal bowstring gripping hand, and draws string 36 to the drawn position while keeping transfer 26 in the slot of receiver 18. The user then grasps transfer grip 34 and bow grip 12 together with his or her bow gripping hand. At this point, the user can take his or her hand off of handle 28, and the bow will remain in the drawn position as long as the user grasps transfer grip 34 and bow grip 12.

Figure 5:
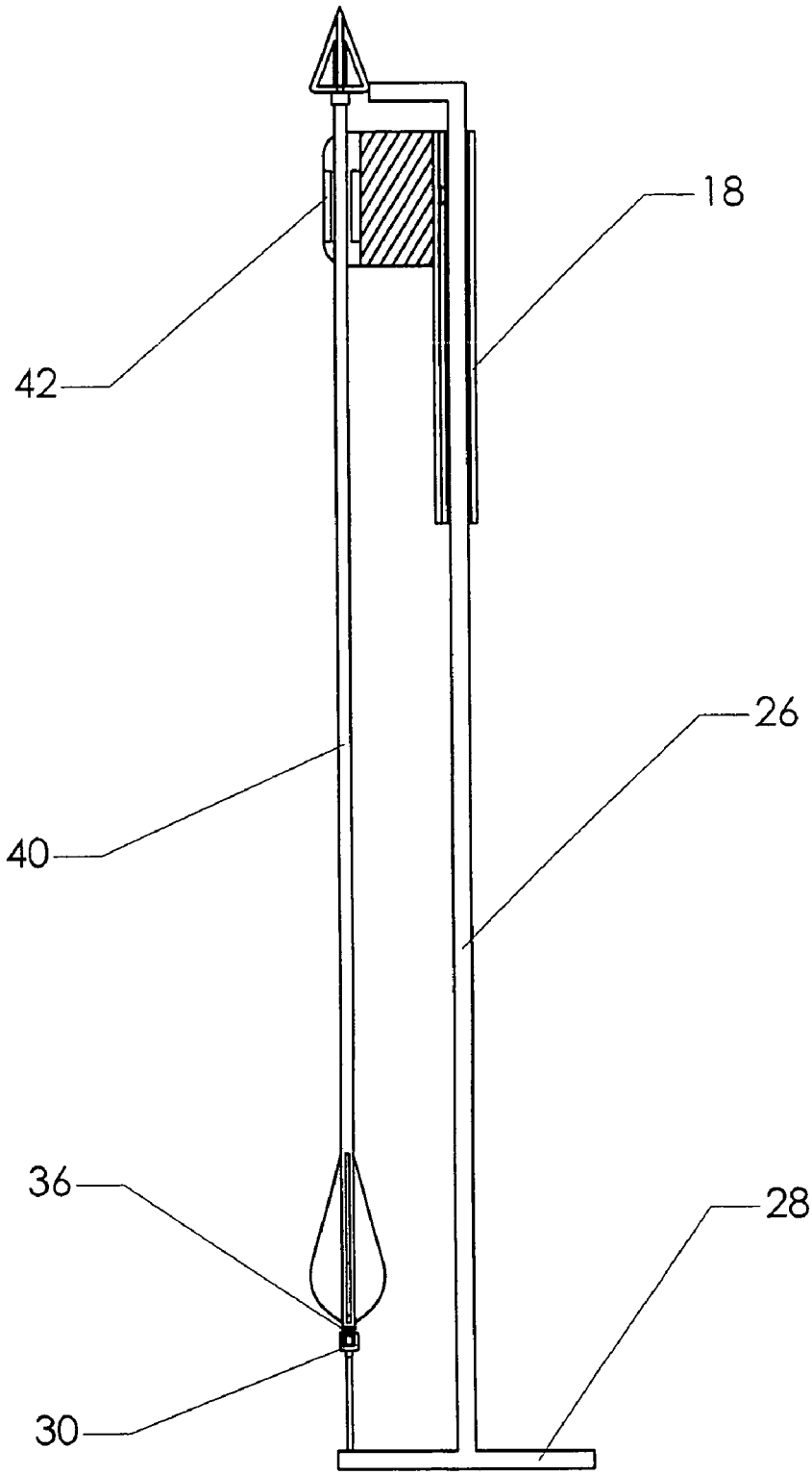
FIG. 5 is a section view, showing the present invention in use.

A section top view is provided showing the present invention in use from above in FIG. 5. To use the present invention in combination with the arrow, the user first grasps bow grip 12 with the bow gripping hand, and places the shaft of transfer 26 into receiver 18. Trigger release 30 is then attached to string 36. Arrow 40 is then placed on to string 36 and arrow receiver 42 so that string 26 engages the notch on the read of arrow 40. The user then grasps handle 28 with the bow string gripping hand and draws transfer 26 together with string 36 and arrow 40 to the drawn position as shown. The user then grasps transfer grip 34 and bow grip 12 together with the bow gripping hand. Trigger release 30 is then used to actuate the release of string 36 and arrow 40 when desired.

Figure 6:
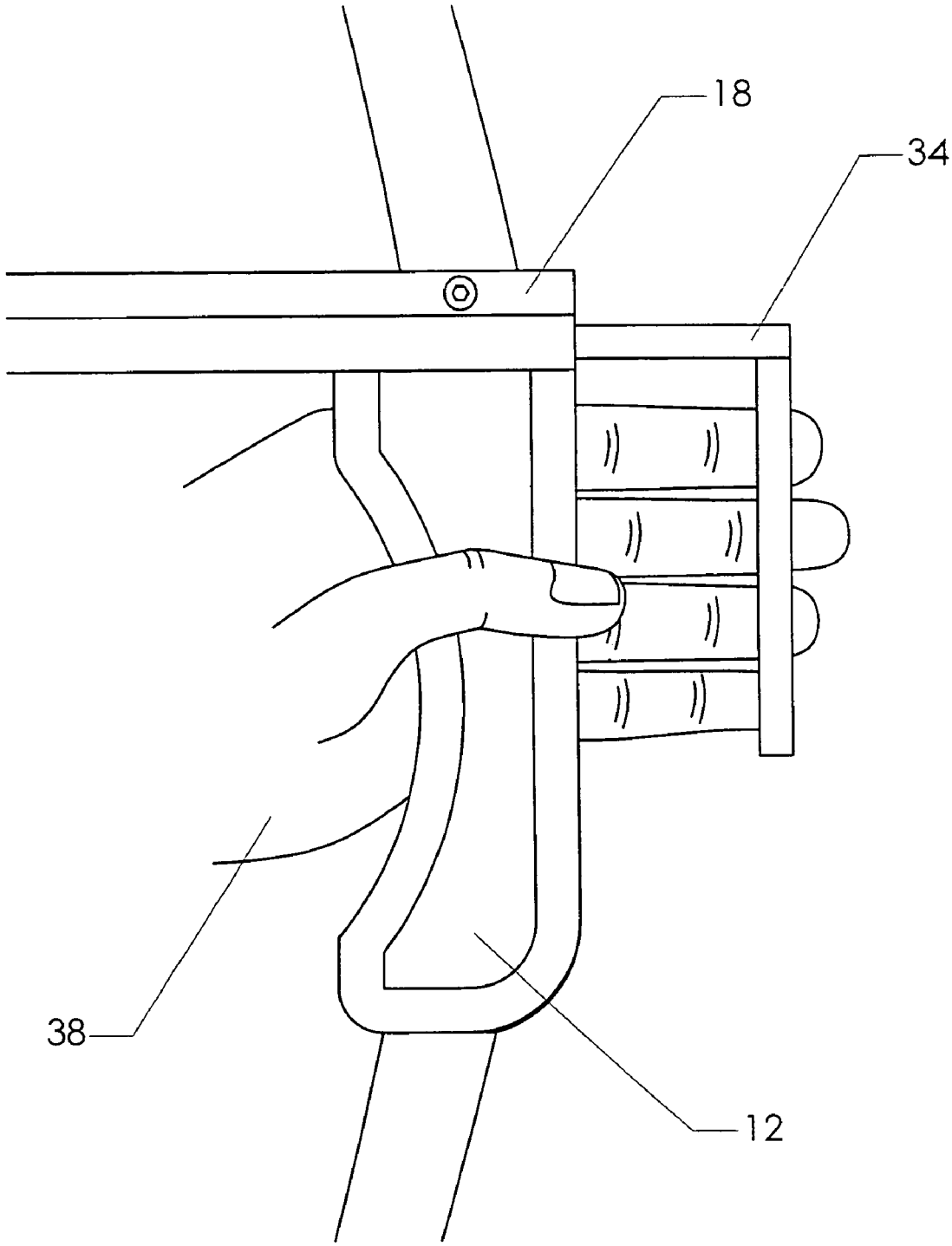
FIG. 6 is a perspective view, showing the present invention in use.
Figure 7:
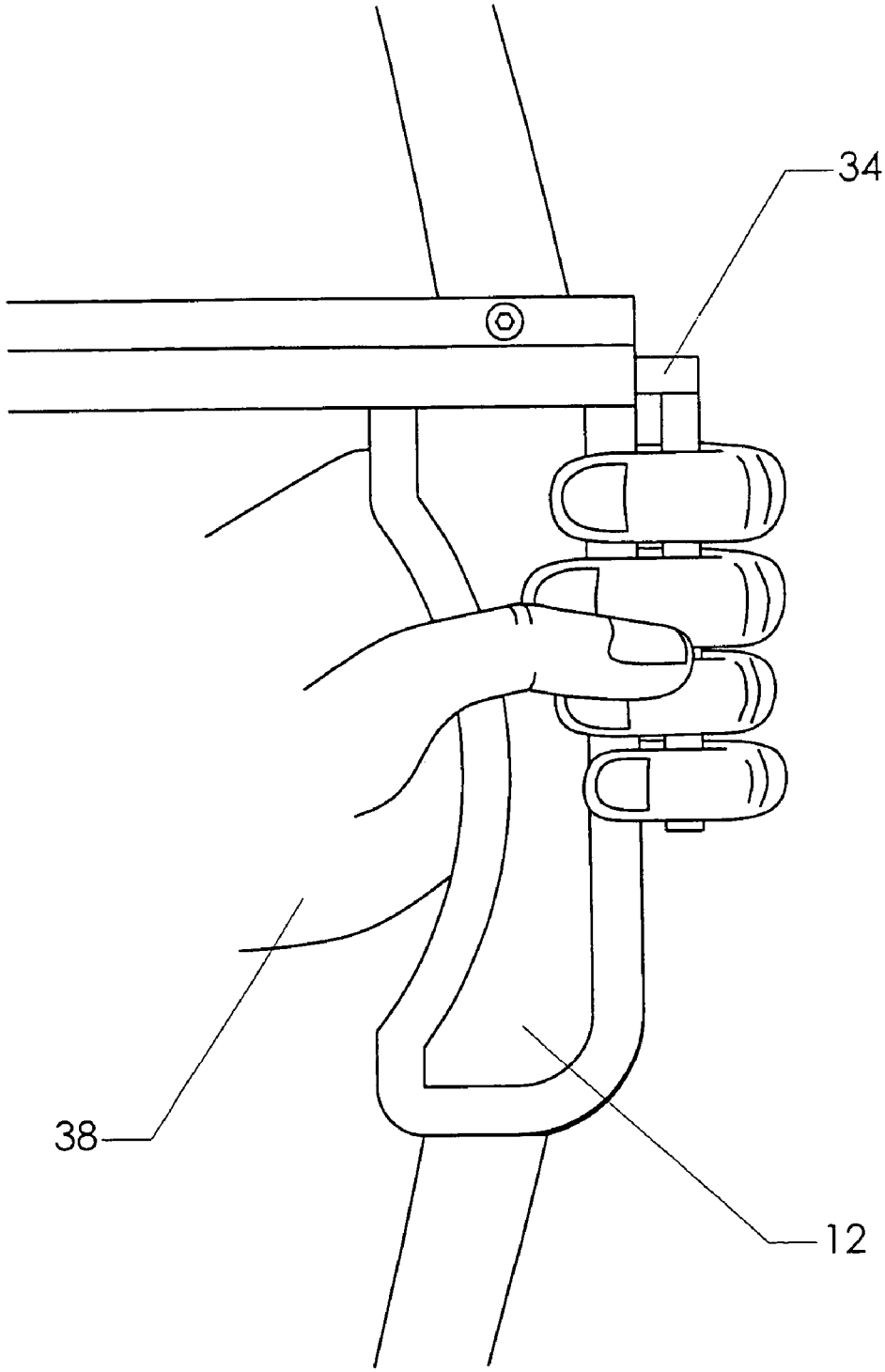
FIG. 7 is a perspective view, showing the present invention in use.

The process by which the user may grasp bow grip 12 together with transfer grip 34 is better illustrated in FIGS. 6 and 7. In FIG. 6, the bow is shown nearly completely drawn. The user opens the hand surrounding bow grip 12 so that bow grip 12 is retained between the thumb and forefinger of hand 38. The fingers of hand 38 are extended so that transfer grip 34 can be drawn against bow grip 12 as transfer 26 slides through receiver 18. The user then closes the fingers around transfer grip 34, as shown in FIG. 7, so that transfer grip 34 and bow grip 12 are grasped together by hand 38.

Although the preceding descriptions contain significant detail they should not be viewed as limiting the invention but rather as providing examples of the preferred embodiments of the invention. For example, trigger release 30 may be attached to transfer 26 at other points than handle 28. Also, handle 28 may be positioned in many configurations with respect to shaft 32 and may be contoured for greater comfort. Similarly, transfer grip 34 may be contoured differently for greater comfort. Accordingly, the scope of the invention should be determined by the following claims, rather than the examples given.

Having described my invention, I claim:

1. A device for transferring the drawn weight of a bowstring from a user's bowstring gripping hand to a user's bow gripping hand when said bowstring is drawn from said undrawn position to said drawn position, wherein said bowstring is attached to a bow having a bow grip, said device comprising:

a. a shaft having a first end and a second end, b. a trigger mechanism for releasably connecting said bowstring to said shaft, said trigger mechanism attached proximal to said first end of said shaft, said trigger mechanism configured to attach to said bowstring and support said drawn weight of said bowstring when said bow string is drawn and configured to release said bowstring when said user actuates said trigger mechanism to release said bowstring;

c. a transfer grip, attached to said shaft proximate said second end of said shaft, said transfer grip including a gripping portion, wherein the distance between said trigger mechanism and said transfer grip is configured so that said transfer grip is positioned proximate said bow grip when said bowstring is drawn such that said user is able to grasp said gripping portion of said transfer grip together with said bow grip in said bow gripping hand when said user draws said bowstring back to said drawn position with said user's bowstring gripping hand; and d. said transfer grip being configured such that when said user grasps said gripping portion of said transfer grip together with said bow grip in said bow gripping hand, said drawn weight of said bowstring is supported entirely by said user's bow gripping hand.

2. The device of claim 1, further comprising:

a. a receiver, mounted on said bow; and b. a slot in said receiver for receiving said shaft, said slot permitting said shaft to slide therein when said bowstring is drawn from said undrawn position to said drawn position.

3. The device of claim 2, further comprising a handle for drawing said bowstring from said undrawn position to said drawn position, said handle attached to said shaft proximate said trigger mechanism.

4. The device of claim 3, said trigger mechanism attached to said handle, and said trigger mechanism including a trigger release.

5. The device of claim 4, wherein said transfer grip is laterally offset from said shaft.

6. The device of claim 3, wherein said transfer grip is laterally offset from said shaft.

7. The device of claim 2, said trigger mechanism including a trigger release.

8. The device of claim 7, wherein said transfer grip is laterally offset from said shaft.

9. The device of claim 2, wherein said transfer grip is laterally offset from said shaft.

10. The device of claim 1, further comprising a handle for drawing said bowstring from an undrawn position to a drawn position, said handle attached to said shaft proximate said trigger mechanism.

11. The device of claim 10, said trigger mechanism attached to said handle, and said trigger mechanism including a trigger release.

12. The device of claim 11, wherein said transfer grip is laterally offset from said shaft.

13. The device of claim 10, wherein said transfer grip is laterally offset from said shaft.

14. The device of claim 1, said trigger mechanism including a trigger release.

15. The device of claim 14, wherein said transfer grip is laterally offset from said shaft.

16. The device of claim 1, wherein said transfer grip is laterally offset from said shaft.

17. The device of claim 1, wherein said gripping portion of said transfer grip has a first end, a second end, and gripping section therebetween, said gripping section being adapted to allow said user to hold said gripping section and said bow grip together in said bow gripping hand, thereby allowing said user to hold said drawn weight of said bowstring with said bow gripping hand alone.

18. The device of claim 17, wherein said first end of said gripping portion is attached to said shaft, and said second end extends away from said shaft such that said gripping section is oriented in a substantially perpendicular direction with respect to said shaft.

19. The device of claim 17, said gripping section being configured to allow said user to wrap at least two fingers of said bow gripping hand around said gripping section while maintaining the user'grasp of said bow grip.

* * * * *